US011684930B1

(12) United States Patent
Wetzel et al.

(10) Patent No.: US 11,684,930 B1
(45) Date of Patent: Jun. 27, 2023

(54) METHOD OF OPTIMIZING MILLING PROCESS USING CHEMICAL IMAGING

(71) Applicants: David Wetzel, Manhattan, KS (US); Mark Boatwright, Manhattan, KS (US); Elieser Posner, Savyon (IL)

(72) Inventors: David Wetzel, Manhattan, KS (US); Mark Boatwright, Manhattan, KS (US); Elieser Posner, Savyon (IL)

(73) Assignees: David Wetzel, Manhattan, KS (US); Mark Boatwright, Manhattan, KS (US); Elieser Posner, Savyon (IL)

( * ) Notice: Subject to any disclaimer, the term of this patent is extended or adjusted under 35 U.S.C. 154(b) by 1,309 days.

(21) Appl. No.: 16/144,948

(22) Filed: Sep. 27, 2018

Related U.S. Application Data

(60) Provisional application No. 62/563,985, filed on Sep. 27, 2017.

(51) Int. Cl.

| | |
|---|---|
| ***B02C 25/00*** | (2006.01) |
| ***B07B 1/42*** | (2006.01) |
| ***B02C 23/10*** | (2006.01) |
| ***B02C 11/00*** | (2006.01) |

(52) U.S. Cl.
CPC ..... *B02C 25/00* (2013.01); *B02C 11/00* (2013.01); *B02C 23/10* (2013.01); *B07B 1/42* (2013.01)

(58) Field of Classification Search
CPC ..... B07B 1/42; B02C 11/00; B02C 23/10; B02C 25/00
See application file for complete search history.

(56) References Cited

U.S. PATENT DOCUMENTS 4,986,997 A * 1/1991 Posner et al. ..... B02B 1/04 241/11
5,164,013 A * 11/1992 Posner et al. ..... A23J 1/12 426/481

(Continued)

OTHER PUBLICATIONS

Boatwright, M.D., Posner, E.S., Lopes, R. and Wetzel, D.L., Profiling Endosperm Purity of Commercial Mill Streams Preceded by Debranning Using Quantitative Chemical Imaging, Cereal Foods World, Sep.-Oct. 2015, pp. 211-216, Vol. 60, No. 5.

(Continued)

*Primary Examiner* — Michael McCullough
*Assistant Examiner* — Kalyanavenkateshware Kumar
(74) *Attorney, Agent, or Firm* — Jeffrey L. Thompson; Thompson Law, P.A.

(57) ABSTRACT

A quantitative infrared chemical imaging method to determine the concentration of a desired high value product in a milling process is used as a basis to optimize the milling process by changing operational parameters, such as sieve size. In a dry milling process, the method can be used to determine the concentration of purified endosperm within heterogeneous solid particulate mixtures containing endosperm and nonendosperm botanical parts. The imaging component accommodates the analysis of particle size statistics for each component of the mixture, based upon the chemical structural characterization. Timely chemical composition and particle size analyses enables informed selection for the optimization of physical separation for the processing of granular solids. The method involves changing sieves within the sifting apparatus based on chemical imaging to provide smaller or larger screen openings to improve separation of endosperm and nonendosperm material from the ground product.

16 Claims, 16 Drawing Sheets
(9 of 16 Drawing Sheet(s) Filed in Color)

(56) References Cited

U.S. PATENT DOCUMENTS

| | | | | |
|---|---|---|---|---|
| 5,211,982 | A * | 5/1993 | Wellman | B02C 9/04 426/483 |
| 9,644,342 | B1* | 5/2017 | Meyers | E02F 3/407 |
| 2011/0186661 | A1* | 8/2011 | Bohm et al. | B02C 9/04 241/24.1 |
| 2012/0002037 | A1* | 1/2012 | Pierri et al. | B02C 4/28 348/93 |
| 2016/0368023 | A1* | 12/2016 | Tüshaus et al. | B07B 1/42 |
| 2017/0056928 | A1* | 3/2017 | Torrione | B07B 1/46 |

OTHER PUBLICATIONS

Gwirtz, J., A New Imaging Method for Millers, World Grain, Oct. 2011, pp. 76-80.

Nickoley, T.R., Method of Physical and Enzymatic Concentration of Extraneous Materials in Wheat Flour to Enable Near Infrared Chemical Imaging, Master of Science Thesis, Kansas State University, 2018.

NIR Quantitative Chemical Imaging, Milling Journal, Third Quarter 2016, pp. 4-10, Vol. 24, Issue 3.

Wetzel, D.L., Boatwright, M.D., and Brewer, L.R., Granular Solid Formulation Commodity Mixture Uniformity Revealed Via InSb Focal Plane Array Chemical Imaging, Vibrational Spectroscopy, 2010, pp. 83-87, Vol. 53.

Wetzel, D.L., Mid-IR and Near-IR Chemical Imaging: Complementary for Biological Materials, Vibrational Spectroscopy, 2012, doi:10.1016/j.vibspec.2012.01.005.

Wetzel, D.L., Positive Assessment of Mill Stream Endosperm Purity Using Chemical Imaging, Cereal Foods World, May-Jun. 2013, pp. 133-137, Vol. 58, No. 3.

Wetzel. D.L., Posner, E.S., and Dogan, H., InSb Focal Plane Array Chemical Imaging Enables Assessment of Unit Process Efficiency for Milling Operation, Applied Spectroscopy, 2010, pp. 1320-1324, Vol. 64, No. 12.

Boatwright, M., Considerations for Quantitation via NIR Imaging Pixel Counting, Microbeam Molecular Spectroscopy Laboratory, Kansas State University, 2010 (Abstract).

Boatwright M.D., Gwirtz, J.A., Posner, E.S., and Wetzel, D.L., A Quantitative Near Infrared Imaging Study of 1 ,2 ,3 Break System Endosperm Yield from Variation of 1BK/2BK Roll Gap Combinations, International Miller, Third Quarter 2013, pp. 35-41.

* cited by examiner

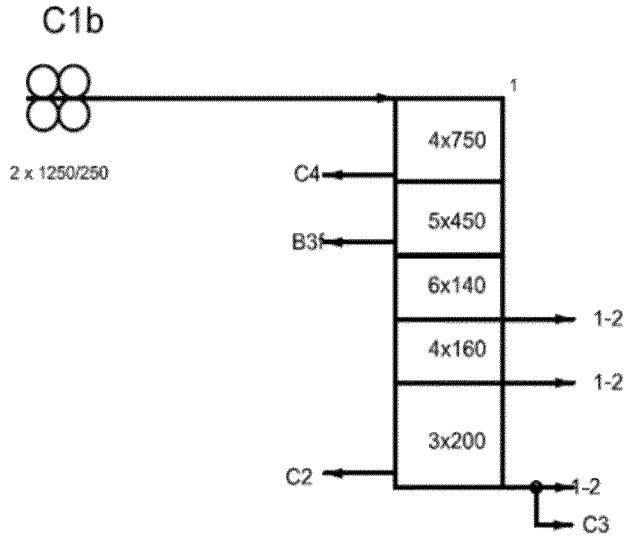
Fig. 11
Fig. 12
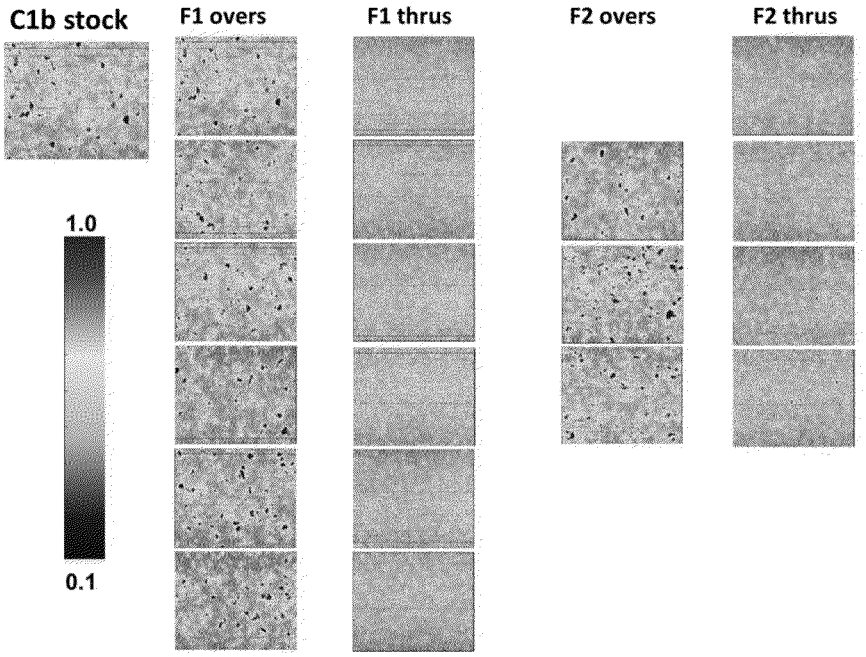

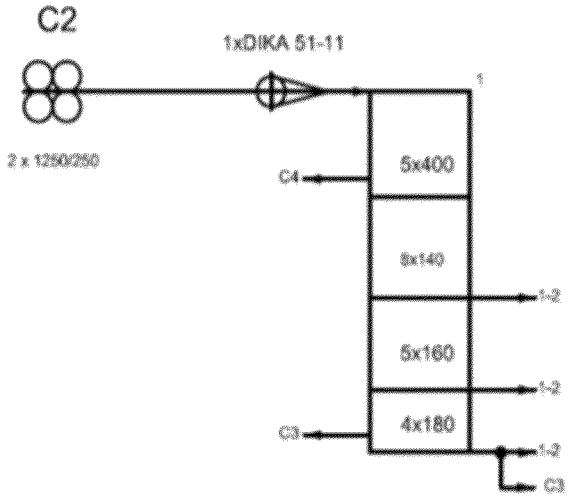
Fig. 13
Fig. 14
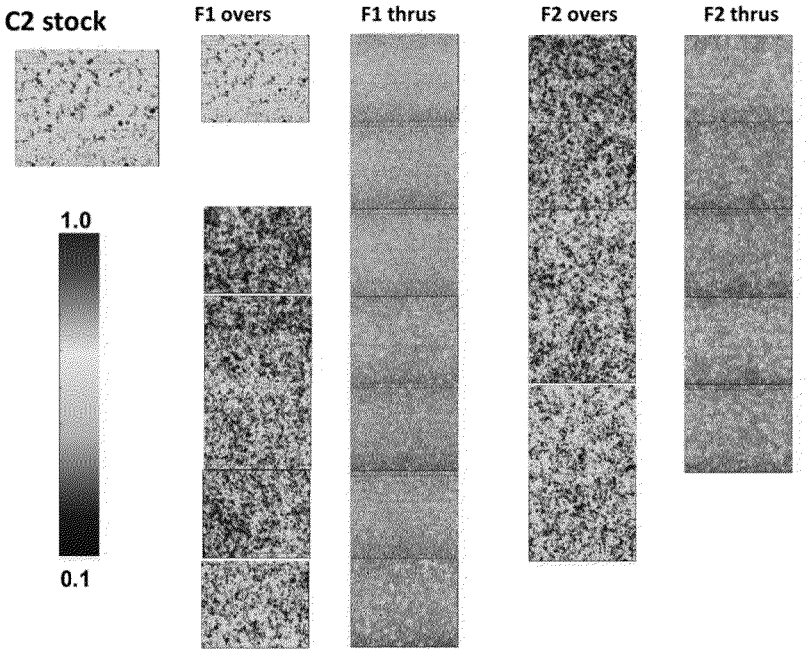

METHOD OF OPTIMIZING MILLING PROCESS USING CHEMICAL IMAGING

RELATED APPLICATIONS

This application claims the benefit of U.S. Provisional Pat. Application No. 62/563,985 filed on Sep. 27, 2017. The entire content of this prior application is incorporated herein by reference.

BACKGROUND OF THE INVENTION

Field of the Invention

A method of optimizing the separation of endosperm and nonendosperm material during a milling process is provided utilizing infrared quantitative chemical analysis of a ground material passing through a sifting apparatus. This method is also applicable to other commercial cereal grains and seeds of similar composition.

Description of the Prior Art

Commercial wheat milling operations work on low economic margins, however, the mass multiplication coefficient for the process is extremely large. For a single milling process, an increased yield of even 1% is significant. Worldwide wheat usage is approximately 730 million tons per year. Given the total wheat production available for milling, 1% would total 7.3 million tons. Using the current US market value for flour of $0.15/lbs., 1% would globally represent approximately $2.2 billion annually.

In 2014, the US wheat milling industry milled approximately 46 million tons of whole wheat to produce 21.2 million tons of flour. The average daily capacity for a US flour mill is 454 tons and the daily capacity of the largest mills are approximately 1500 tons. This leads to an average flour extraction rate of approximately 76.9%. Whereas the international wheat milling industry trend is toward a minimum extraction rate of 79%, there is considerable room for improvement domestically. For the average US mill, increasing the extraction rate by only 1% would produce an additional 1275 tons of flour annually. Thus, a 1% increase in extraction rate would approximately produce an additional $380,000 annually. For the largest US mills, increasing the extraction rate by just 1% would produce an additional 2800 tons of flour annually. Thus, a 1% increase in extraction rate would approximately produce an additional $850,000 annually.

Quality assurance practices currently evaluate the total flour produced from each sifter section by determining the mineral content or by a simple colorimetric analysis. However, the current practice does not evaluate the extracted flour from each individual sieve in a section. Traditionally, analytical tests of the past are intended to estimate the bran contamination of the otherwise pure endosperm. The ash test gravimetrically determines the mineral residue upon ignition of the organic compounds. This approach is valid only among wheats grown in the same soil. In the modern setting of import or export, wheat milling ash determination has become meaningless. Off color measurement is gradual and not of sufficient sensitivity to enable informed, minor adjustments of the milling operational parameters. Previous application of near infrared methods have either insufficient resolution or lengthy data processing and acquisition times.

SUMMARY OF THE INVENTION

The proposed invention has a molecular structural basis to distinguish endosperm from other botanical parts of grain kernels by taking advantage of the advanced state of the art in near infrared chemical imaging technology. This dedicated instrumentation provides the sensitivity to determine small differences in analyte concentrations (in this case, wheat endosperm) based upon distinctions in the chemical composition and the spatially resolved images, and the ability to produce particle size distribution data. The wavelength range used provides high selectivity for organic functional groups. In the past, an empirical, indirect trial and error process was used to achieve optimal physical separation of the chemically differing particles within a mixture of ground wheat by size. In contrast, the present invention distinguishes the wheat endosperm from other regions of the kernel by infrared spectroscopy based upon its distinct chemical signatures at select indicator wavelengths to enable quantitative determination of the endosperm in meaningful numerical terms. Employing this direct, chemical method can speed up optimization of the physical separation process for numerous unit processes with the cumulative wealth of analytical information provided with each individual chemical analysis.

A custom spectroscopic analytical procedure is employed in this invention. This involves treating the heterogeneous mixture as a binary mixture (endosperm vs. nonendosperm) to simplify the quantitation. The purpose is to develop a calibration that is objective and reduces adverse effects of infrared measurement. Another unique aspect of the data processing is the heretofore unrealized potential for the streamlining of the procedure with a custom software interface allowing at-line testing. The user receives a simplified table of numerical results and has access to the false color images to observe the distribution and size of the particles of material A and B.

For the milling industry, this method provides sensitivity and selectivity not achieved by the previous analytical methods. Employing this direct, chemical method can speed up optimization of the physical separation process for numerous unit processes with the cumulative wealth of analytical information provided with each individual chemical analysis. The data acquisition and data processing element of the present invention can be performed on several different spectroscopic imaging instruments and multiple software platforms with modification to the automated platform.

The novelty of this approach in terms of analysis of flour mill processing is the development of an ideal configuration for the flour (product) sieves based upon chemical imaging data. This requires analysis of the material flowing over or passing through each individual flour (product) to determine an optimal sieve aperture size to achieve purity and maximize yield. Milling operations tend to comprise a complex progression of sequential physical processing steps that rejected byproducts of a preceding operation or operations provides stock for downstream further processing, resulting in interdependence of successive size reduction and segregation. Thus, the numerical and molecularly selective information provided enables economically beneficial orchestration of the overall multi-phase grain milling operation. Similarly, other dry milling procedures are used to isolate the starch or other components from other grains and seeds. Considering the comparable chemical and botanical composition of these plants, it is credible to assume that monitoring the efficiency of these separations is also relevant to the scope of the patent.

Another market of the wheat milling industry is durum wheat used for pasta production and the objective is to segregate pure endosperm from nonendosperm in a course granulation range (300-600 μm), while reducing the production of fine particulate byproduct. As the global pasta market continues to grow, competition in the durum milling industry demands increased efficiency. Similarly to flour milling, the presence of nonendosperm impurities that produce an off-color reduces the value of the coarse endosperm product (semolina). The production of fine particles subject to starch damage is also detrimental to pasta production. When abrasion preprocessing is used, the bran content of individual kernels is significantly reduced. As the various milling unit processes are applied, particle size is reduced and coarse endosperm particles are separated from nonendosperm. In the purifier operation for durum milling, the particle size, specific gravity, and air flow are used to achieve further differentiation and separation. The chemical imaging method provides an objective mechanism to assess small differences in the distribution of endosperm throughout the many unit processes.

The application of the method begins with the construction of the library for that particular wheat crop. Historic libraries can be applied after working with a mill. After an initial assessment of the mill, key sieve sections can be targeted. The mill is then sampled and analyzed during a scheduled shutdown. The results then allow optimization based upon a decision tree. At least one followup is required to reach the targeted increases.

The chemical specificity herein designated and the rigorous numerical definition of endosperm purity provides the means of measuring the efficiency of individual particle size reducing (grinding) processes in grain milling. Unlike previous expressions of impurity content, the present invention has an absolute positive numerical basis of purity with respect to the molecular structural chemical features manifested via vibrational spectroscopic characterization and definition.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 11 is a diagram of another sieving operation used in a wheat milling sieving process.

FIG. 12 are chemical images of samples taken from the stock, overs and thrus of the sieving operation shown in FIG. 11.

FIG. 13 is a diagram of another sieving operation used in a wheat milling sieving process.

FIG. 14 are chemical images of samples taken from the stock, overs and thrus of the sieving operation shown in FIG. 13.

DETAILED DESCRIPTION OF THE INVENTION

The method of using chemical imaging to optimize product purification in a milling process according to the present invention will be explained in detail with reference to FIGS. 1 to 18 of the accompanying drawings.

Grain Milling Process

Figure 1:
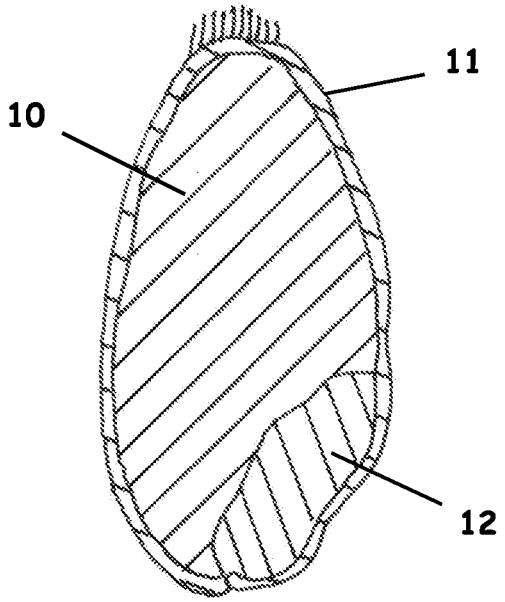
FIG. 1 is a diagram of a typical seed of an angiospermic plant, such as wheat.
Figure 2A:
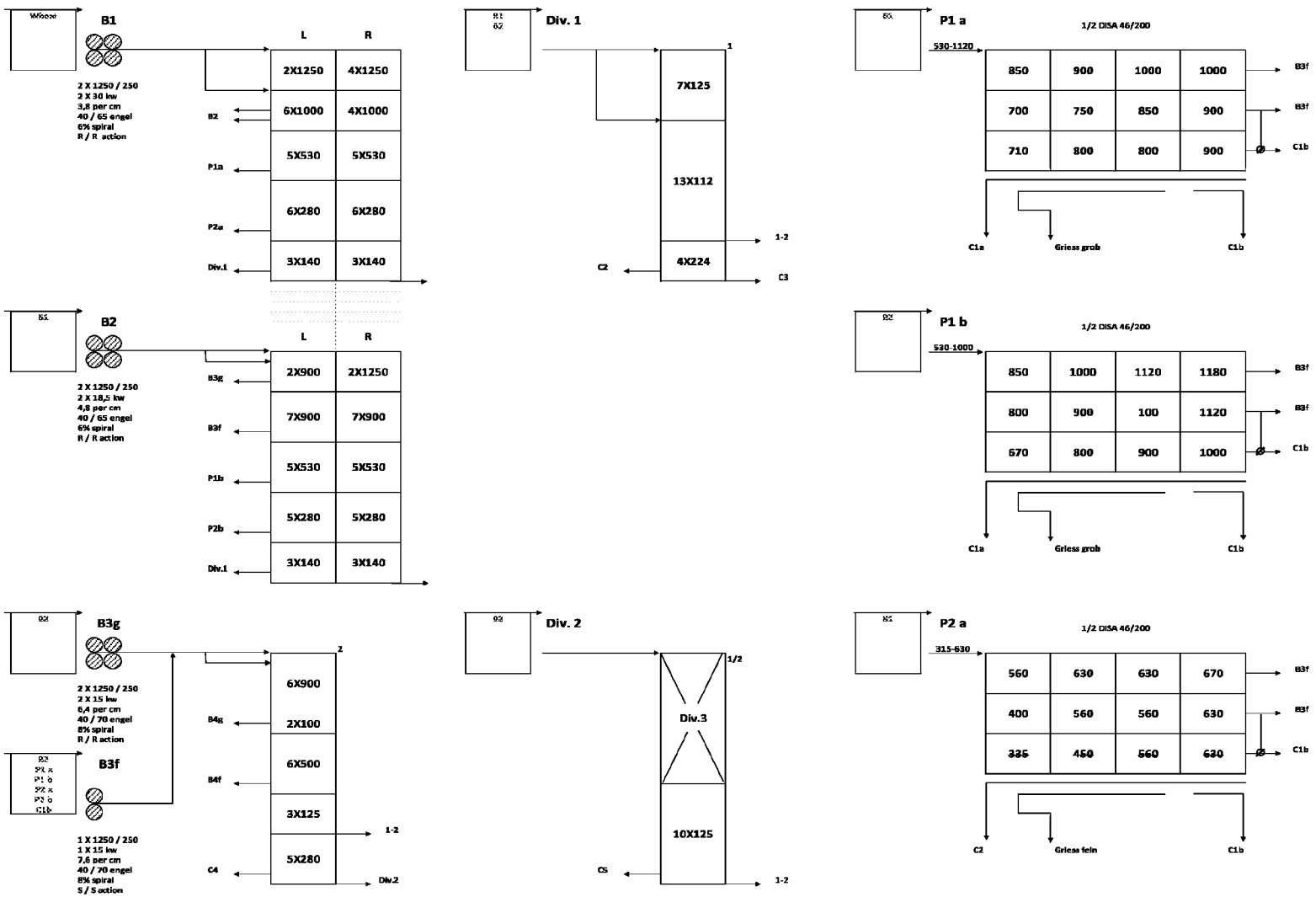
FIGS. 2A to 2D collectively comprise a schematic diagram of a conventional milling process.
Figure 2B:
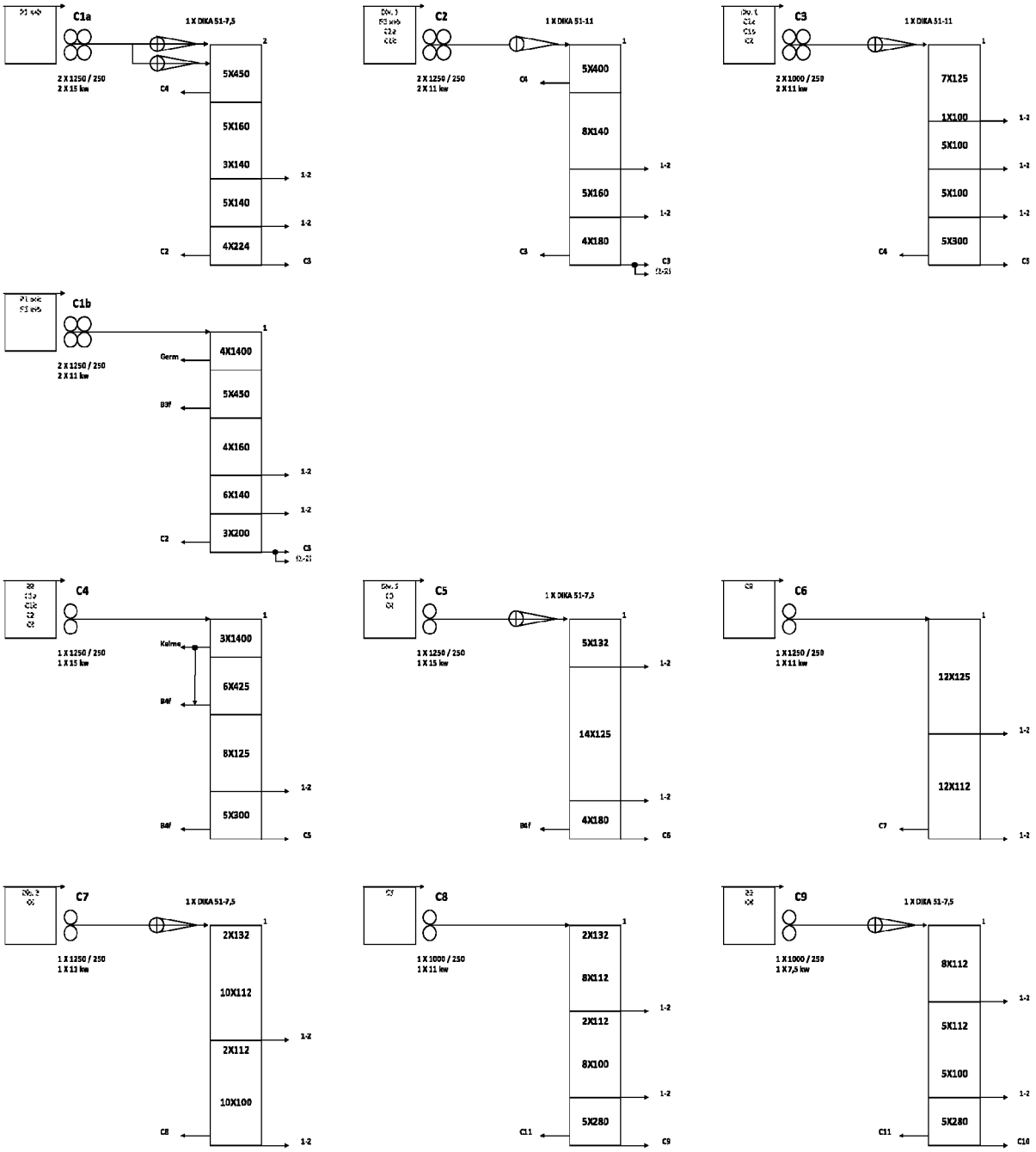
Figure 2C:
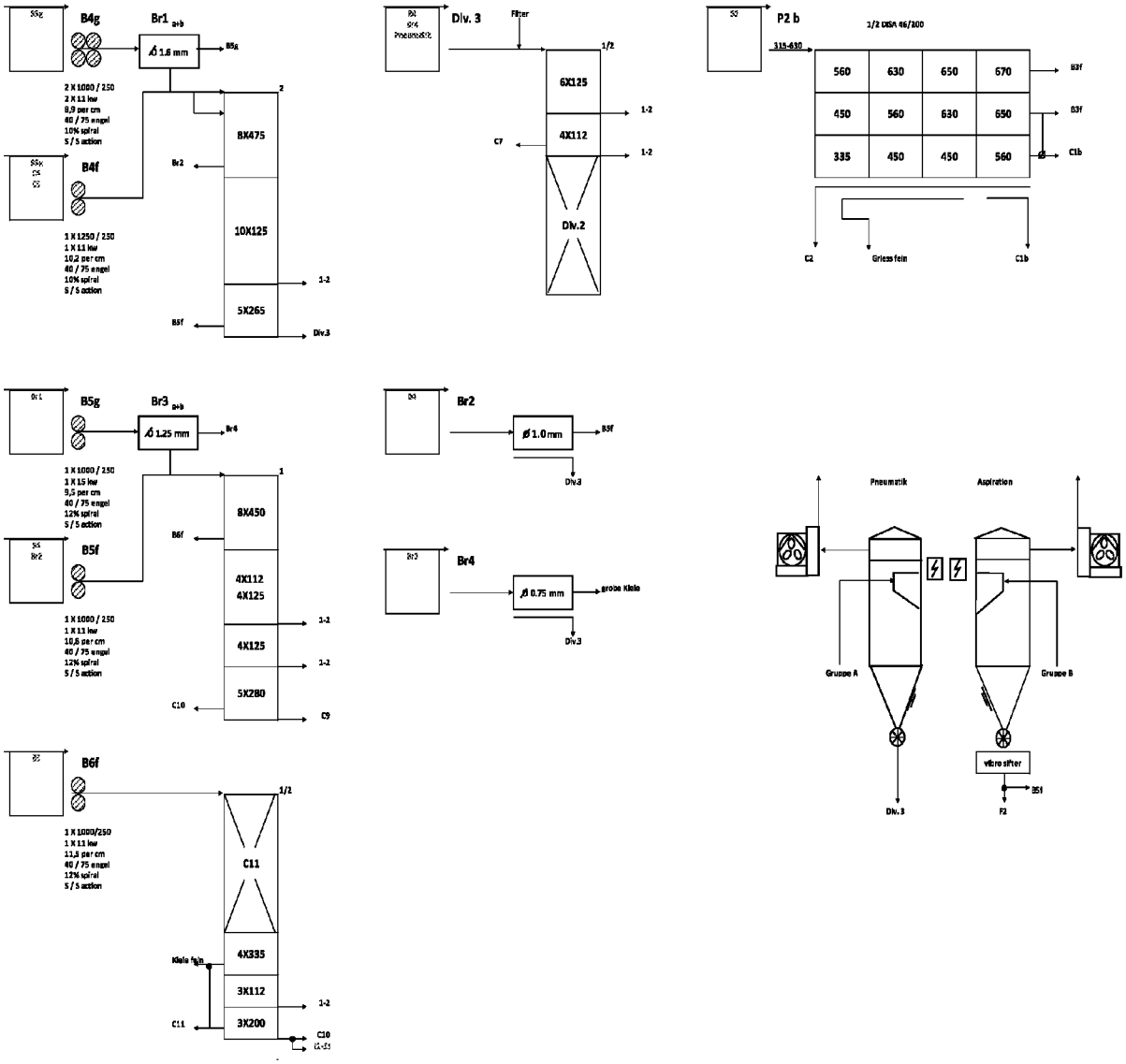
Figure 2D:
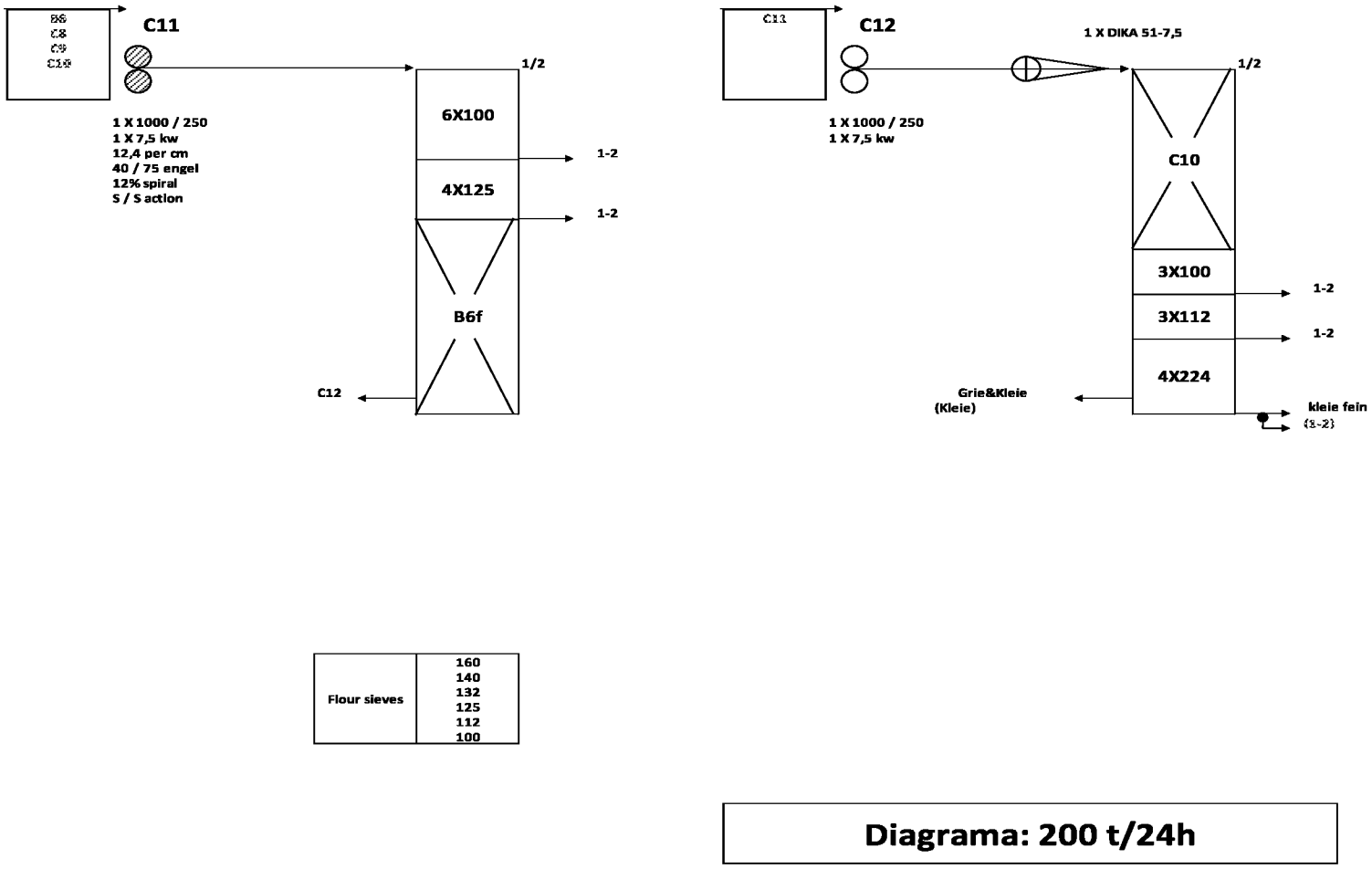

A typical grain milling process comprises a combination of gradual grinding for particle size reduction and repeated classification by sifting. The objective is to separate the three main physical parts of the grain kernel; endosperm 10, bran 11, and germ 12 as efficiently as possible (FIG. 1). The overall efficiency of the process is measured by the purity and yield of product based on ideal separation. The present invention can be applied to milling processes for a variety of cereal grains, including but not limited to wheat, rice, sorghum, oats, rye, corn and quinoa.

The milling process will be described by the flow sheet diagram shown in FIGS. 2A to 2D, where the successive grinding rolls and sifting stages are shown in detail. The flow sheet specifications of grinding stages show the type of action (grinding or reduction), while sifting stages indicate the aperture of sieves in a sifter section. Note for reference that there are 21-unit processes in the commercial scale mill used in various trials of the present invention.

Figure 3:
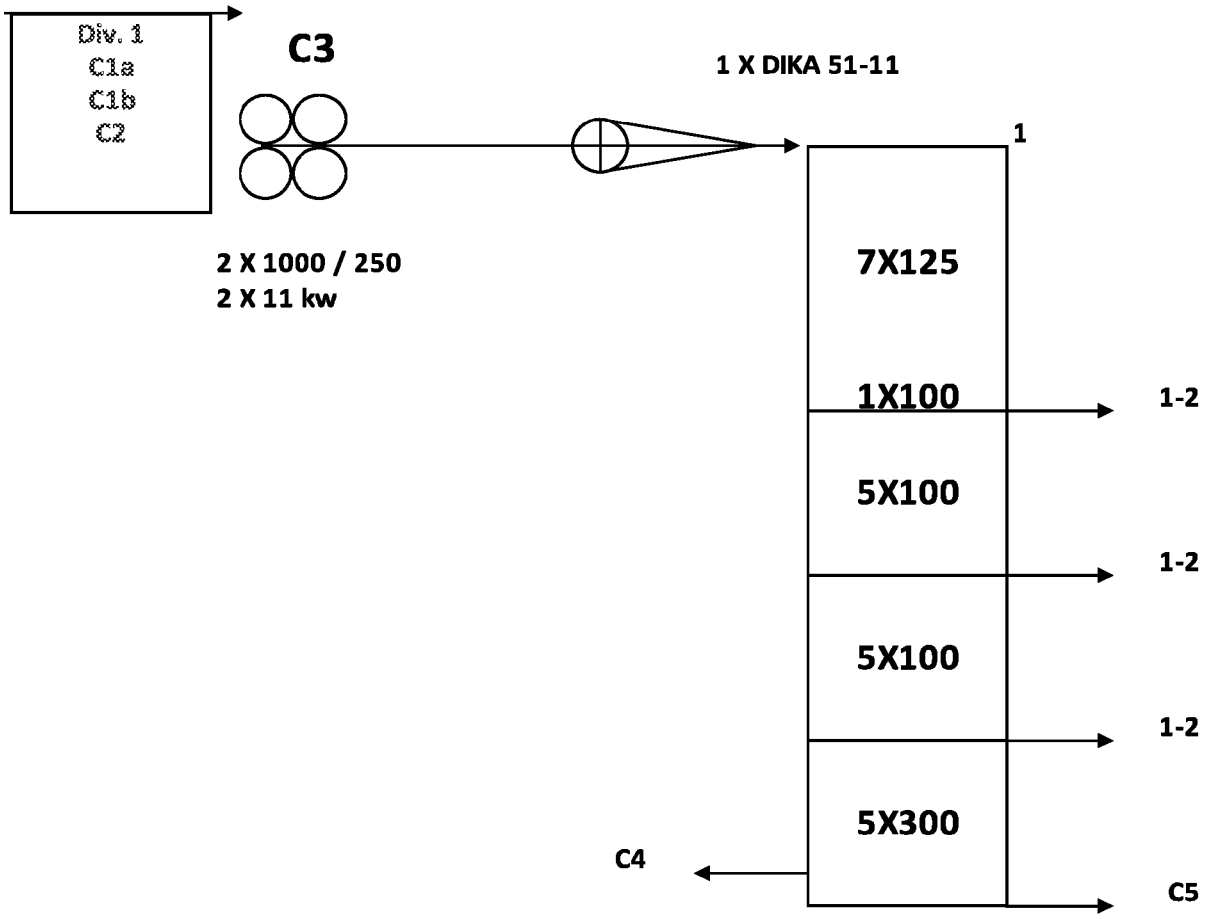
FIG. 3 is a schematic diagram of a conventional unit process.

FIG. 3 is a flow sheet that illustrates one of the unit processes in detail. The flow sheet indicates four processing streams distributed evenly between two pairs of smooth rolls with a fixed area of roll surface and energy consumption. The ground material from the rolls is carried by air flow and directed to a sifter with designations for # of replicate sieves × aperture dimension (μm). Note that the material over each sieve passes to the next (except for the C4 material over the last sieve). The arrows below each group of sieves designates the destination of the material through the sieve (in this case, 1-2 indicates a flour stream and C5 indicates a later processing step).

Figure 4:
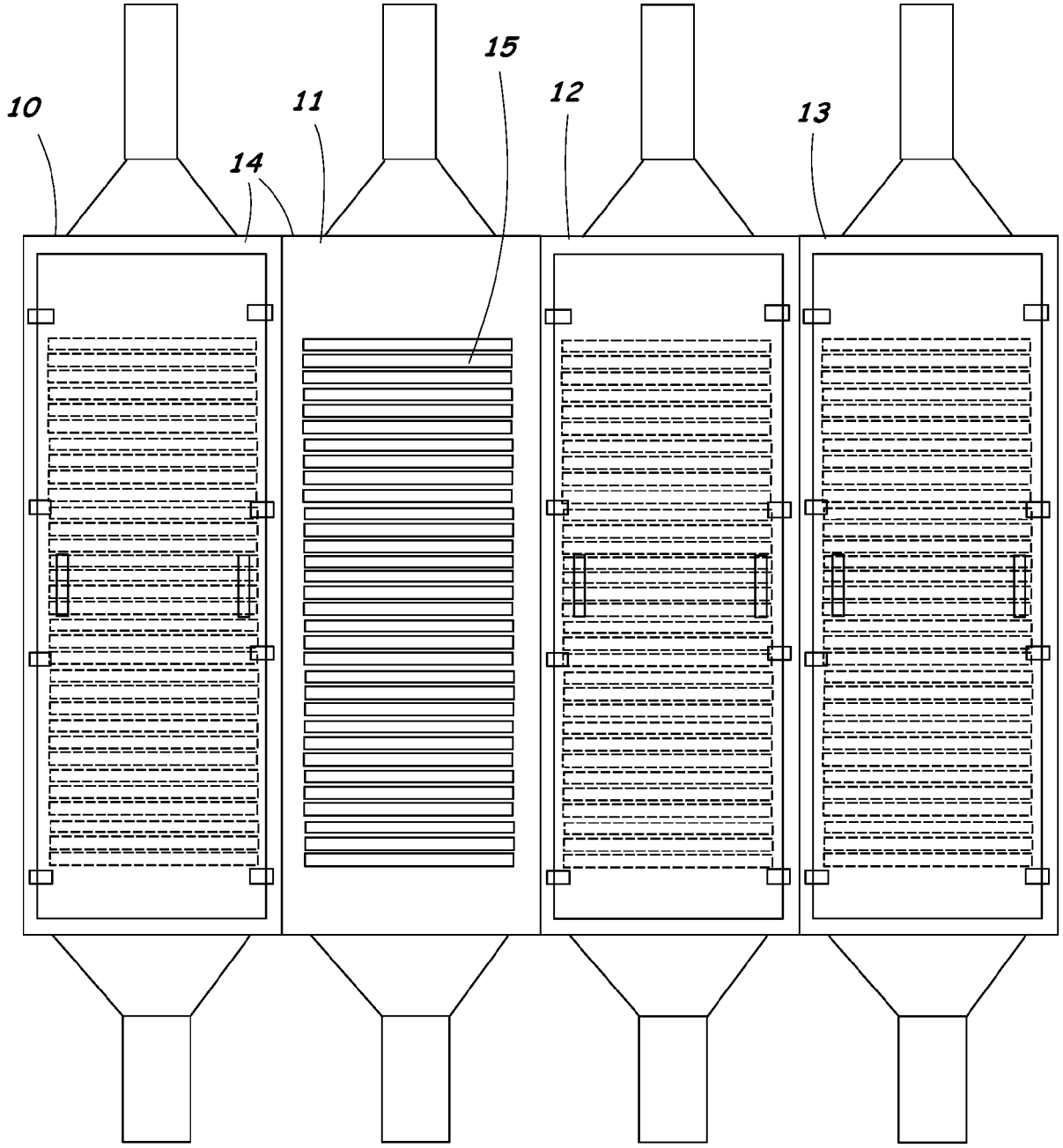
FIG. 4 illustrates a bank of multi-section commercial sifting apparati used in a milling process.

FIG. 4 illustrates a bank of multi-section commercial sifting apparati used in a commercial milling process. In FIG. 4, there are four sifter sections 10, 11, 12, 13, each comprising a housing 14 and a stack of sieve frames 15 with sieves of different apertures stretched upon them. Sifter section 11 is shown with its front panel removed to show the stack of sieve frames 15 therein.

The sieving provided by the sifter sections 10-13 is based on the principle of sorting the incoming stock after each grinding stage to different particle sizes by the various descending sieve apertures. The size distinction selectively separates different botanical parts. It is general practice to show in the flow sheet groups of sieves with specific apertures for a particular size separation in each sifter section. Groups of sieves in the range between 110-220 microns are generally shown in the flow sheet for flour separation.

Chemical Imaging

The present invention comprises an analytical method that directly measures the endosperm purity during the refinement of grain kernels or similar analyte/matrix systems for other materials. Because the method identifies distinctive chemical composition features of the analyte, it meets the requirement of individual botanical part selectivity and specificity. The method is very sensitive to small differences in purity of the analyte due to the presence of other botanical parts.

The present invention uses a chemical imaging process to determine the content of a sample of product taken from a mill stream in a milling process, and changes at least one operational parameter of the milling process based on the results of the chemical imaging to optimize the milling process. As used herein, the phrase "chemical imaging" refers to a process of creating a visual image of a distribution of components in a mill stream from simultaneous measurement of spectra to enable quantification of the components. For example, in the case of a mill stream of a grain milling process, the present invention uses chemical imaging to quantify the components of seeds in a sample of the mill stream. In the embodiment described herein, near infrared spectroscopy is used as the spectral measurement technique. It is contemplated that other types of spectroscopic instruments could also be used to perform chemical imaging suitable for use in the present invention.

Figure 5:
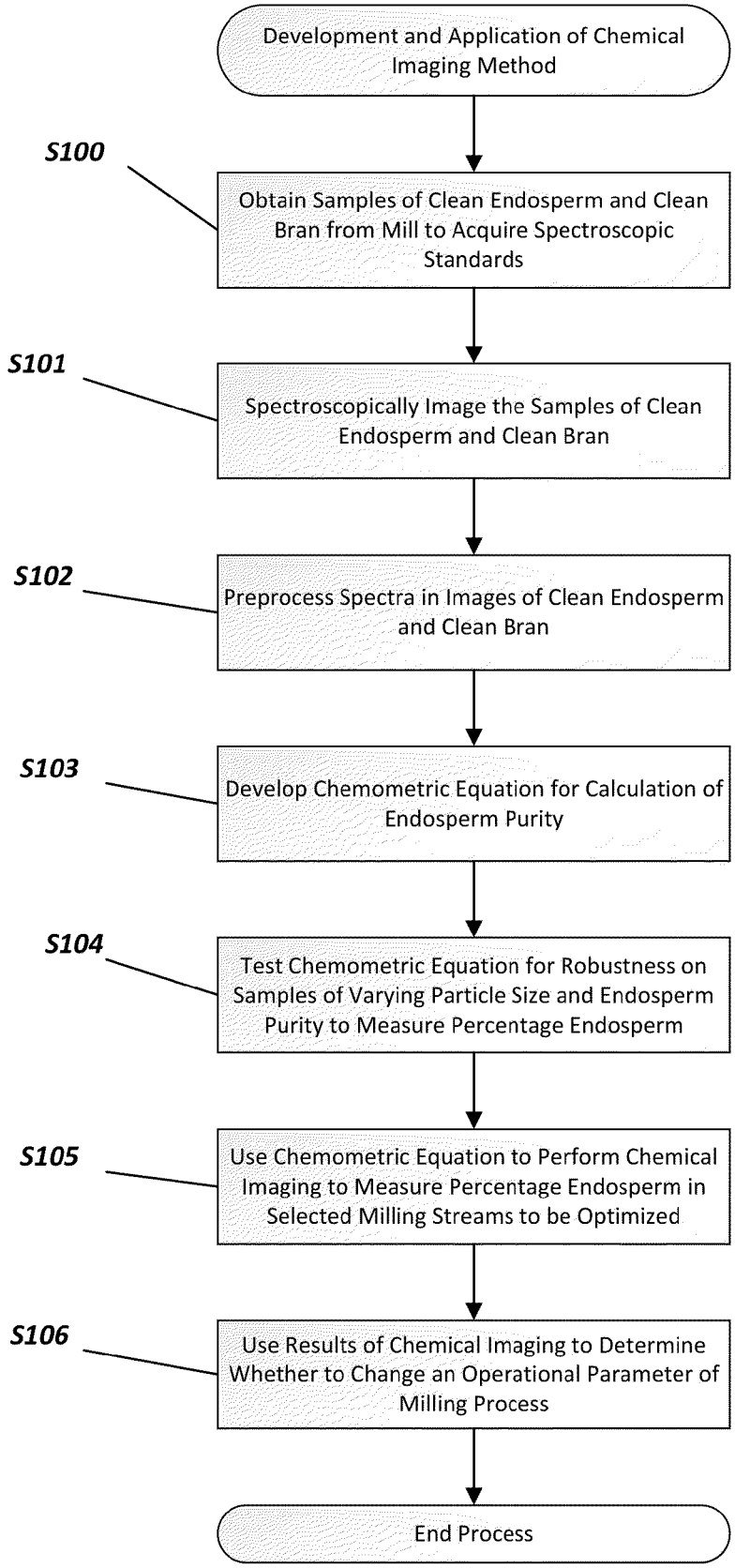
FIG. 5 is a flowchart depicting the development and application of a chemical imaging method used in the present invention.

FIG. 5 is a flowchart depicting the development and application of a chemical imaging method used in the present invention. The method first involves acquiring spectroscopic standards for the particular mill being optimized. In step S100, samples of clean endosperm and clean bran are obtained from the mill to acquire spectroscopic standards. These samples of clean endosperm and clean bran can be selected from different places in the mill and may require additional purification steps.

The standard samples are then spectroscopically imaged in step S101, and the spectra in the images of the clean endosperm and clean bran are preprocessed in step S102. The preprocessing can be accomplished with software that automatically converts the raw data of each spectrum into Absorbance (Abs = log 1/[(S-D)/(R-D)]), and then truncates each spectrum to a predetermined spectral region (e.g., 926 to 2230 nm). A baseline subtraction algorithm with a quadratic polynomial function and a baseline range of 0 is then used with each spectrum with predetermined baseline points to reduce noise (e.g., 926, 1108, 1296, 1848, and 2218 nm). Then, a second spectral truncation of the excess spectral data is performed at additional predetermined spectral regions (e.g., 926 to 1660, 1842 to 2017, and 2218 to 2525 nm) to reduce file size and increase processing speed. The spectral voids are then filled with zeros to avoid complications with the calculations. A normalization (i.e., mean center and scale to unit variance by spectrum) procedure is performed to to each spectrum to reduce the variance between data points that are out of focus.

Using the results of the preprocessing described above, chemometric equations are developed for calculation of endosperm purity (i.e., quantification of endosperm vs. nonendosperm) in step S103. Spectra from select regions of replicate images of endosperm and non-endosperm sample data are used to develop PLS libraries in excess of 400,000 pixels. Two component classes are created; A, clean endosperm; and B, clean bran. The normalized standard data files are then used to develop two separate partial least squares (PLS1) characterization calculations for each class (i.e., endosperm and non-endosperm).

The chemometric equations are then tested in step S104 for robustness on samples of varying particle size and endosperm purity to measure percentage endosperm. Samples can be preprocessed in the same manner as the standards and analyzed by the software to produce the result for percentage endosperm. For example, the data for each sample can be subjected to each PLS characterization calculation, which gives each pixel in the tested images a score from 0 to 1, where 1 is an exact match to spectra for that library class. The two classification images can then be entered into an algorithm (A/A+B), and the mean value for all of the pixels yields the quantitative result of the tested image.

The chemometric equations are then ready to use to perform chemical imaging to measure percentage endosperm in selected milling streams to be optimized in step S105. The results of the chemical imaging are then used to determine whether to change an operational parameter of the milling process in step S106. The method of using the results of the chemical imaging to optimize product purification in a milling process is explained below with reference to FIG. 8.

An example of a chemical imaging procedure used in the present invention is described in more detail in Boatwright et al., "Profiling Endosperm Purity of Commercial Mill Streams Preceded by Debranning Using Quantitative Chemical Imaging," Cereal Foods World 211 (2015) (referred to herein as "the Cereal Foods World paper"), which is incorporated by reference herein in its entirety. The Cereal Foods World paper describes a chemical imaging process suitable for use in the present invention, but does not disclose a method of optimizing a milling process by changing operational parameters of the milling process based on such chemical imaging. The present invention provides such a method for optimizing a milling process.

An infrared microscopic chemical imaging instrument is used to acquire spatially resolved spectroscopic imaging data for granular solid processing specimens. Libraries of thousands of spectra are developed with analytical standards for pure analyte and possible contaminants (pure product and byproducts). Multivariate statistical data treatment of spectra from individual image pixels against the reference libraries results in spectroscopic (chemical) characterization. The summation of analyte concentrations for each pixel within an image produces the quantitative result. Imaging enables visual representation (in the form of false color intensity) of the heterogeneous particle size distribution. This method produces a valid, measureable quality criterion based on purity.

More specifically, a near infrared imaging system (Sapphire model, Malvern Instruments Ltd.) that provides 81,920 near infrared spectra per field of view was used to acquire spectral data cubes for each flour sample. The near infrared imaging spectrometer, which is equipped with four quartz tungsten halogen source lamps, employs a rectangular thermoelectrically cooled array of indium antimonide detector elements. A liquid crystal tunable filter provides electronic wavelength switching that enables simultaneous spectral acquisition at each x,y coordinate (pixel) in the detector array and has no moving parts. The associated software controls optical data acquisition after establishing the maximum reflectance when focusing on the surface of a ceramic standard and obtaining the dark current value with no object at the focal point of the quartz objective. Before spectral acquisition, the granular sample material is placed in a metal planchette and covered with a 1 in. x 1.5 in. glass microscope slide. Within the 1,200-2,400 nm wavelength range, select segments were scanned. A scanning step size of 3 nm was used to limit acquisition stare time, while providing adequate spectral resolution to discriminate pure endosperm from nonendosperm.

For brightness measurements, a reflectance colorimeter (CR7 410 Chroma Meter, Konica Minolta) equipped with a pulsed xenon flash lamp, optical fiber conductor, and diffusing elements was used to illuminate the circular target area (50 mm). Reflected radiation at 90 degrees from the specimen surface was transmitted to six silicon photodiode detectors. The repeatability standard deviation specification was 0.07 AU. The 1931 CIE defined color space responses of three wavelength spectral features for colorimetry were closely matched. All flour streams have a similar brightness because in highly white specimens, where the optical response slope is small, discrimination between similar flour streams is a photometric challenge. Visible color (L* value) was measured on-site using the colorimeter to obtain a numerical index of brightness that matches consumer expectations. A more sophisticated reflectance spectrometer marketed by the same manufacturer, as well as other vendors, that could potentially be applied to color measurement provides a 10 nm bandpass, with a xenon flash lamp source, fixed spectrograph, and 60 element silicon photodiode array. Nevertheless, the visible absorption bands of wheat bran are broad.

Figure 6:
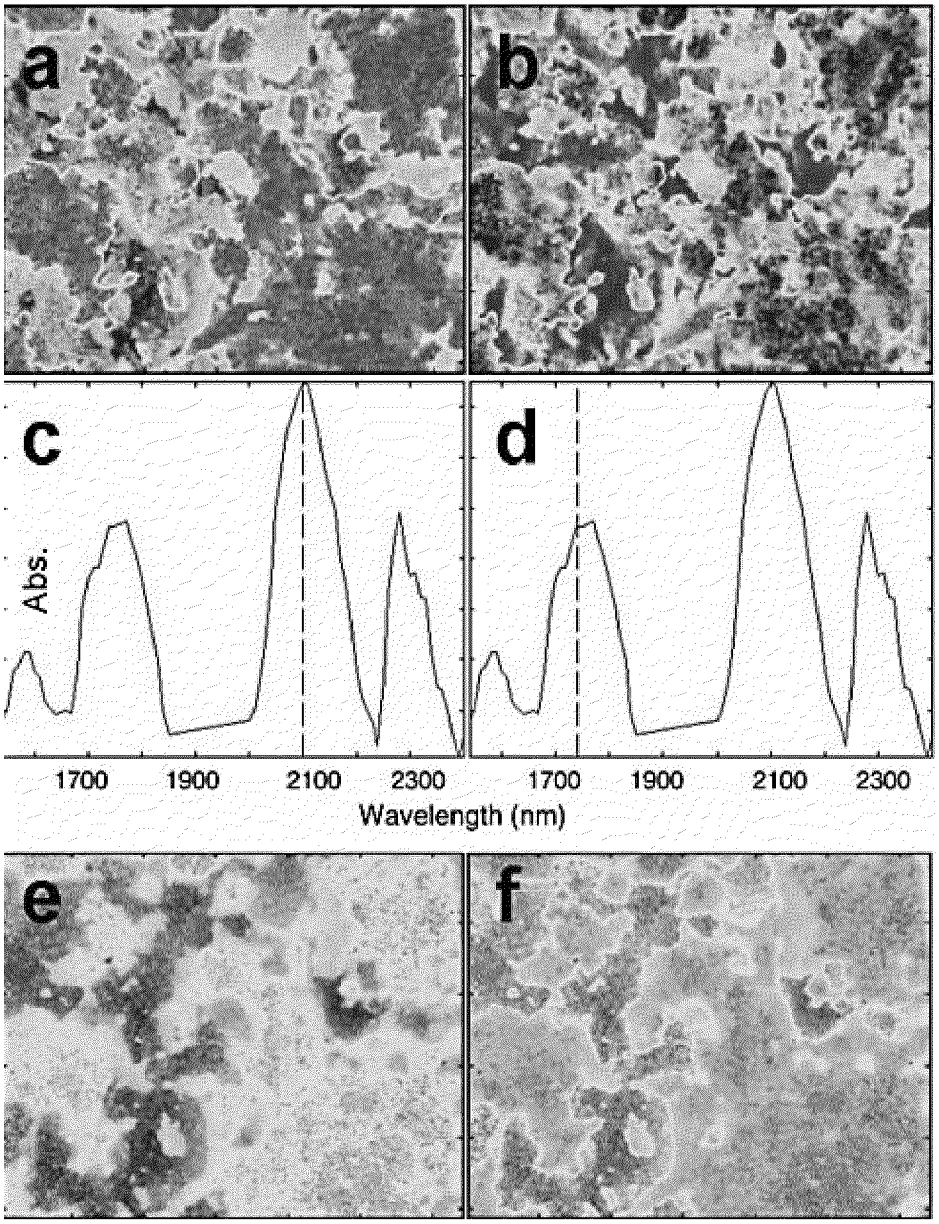
FIG. 6 shows chemical images of samples of ground corn and soybean meal, along with spectra of the respective wavelengths enabling the discrimination, and multivariate statistical contrast of the images.

Broadband electronic spectra phenomena and vibrational spectra were contrasted. The fundamental distinction between the spectral forms is that broadband color results from excitation of electrons, and the vibrational motion of chemically bonded atoms reveals molecular structural features. Thus, using first principles, the vibrational features allow chemical discrimination, as depicted in FIG. 6. More specifically, FIG. 6 shows an example of specific wavelength dependent, contrast enabling, selective discrimination of two components within a binary mixture (in red false colors) for ground corn a) and soybean meal b), respectively. The respective wavelengths enabling this discrimination, corresponding to starch and protein, are marked in spectra c) and d). Multivariate statistical contrast from the same images appears as e) and f).

It is fortuitous that the rate of change in the log (1/reflectance) that accompanies the change in chemical composition is readily measured by the image pixel. Chemical heterogeneity is revealed in the image that allows mathematical summation of individual values within the field of view. The slope of the cumulative endosperm purity curve and the endosperm contribution in each flour stream allows computation of the net purity achieved by selective exclusion of one or more inferior flour streams.

The difference in chemical structure between endosperm and nonendosperm content was used to sort and identify the pixels in each image spectroscopically. For each pixel, a near infrared spectrum was produced in 3 nm steps from 1,650 to 1,788 nm and from 2,150 to 2,228 nm. If a simple binary designation of 1 for endosperm and 0 for <0.5 endosperm is used, the arithmetic amounts to simply counting the pixels of endosperm and dividing by the total number of pixels. The area targeted for analysis was 12.81 mm X 10.24 mm, resulting in a pixel size of 40 μm. The raw image intensity of each image pixel was first converted to absorbance, which describes optical density. The spectra were then baseline corrected and normalized.

PLS data treatment is used in which the binary designation is replaced by assigning an intermediate numerical value to each of the 81,920 pixels in the field of view analyzed. Careful establishment of the purity (endosperm) standard was selectively acquired for this purpose, and the impurity (nonendosperm) standard was spectroscopically defined by clean bran. PLS classification according to spectral libraries (more than 240,000 spectra for each component) defining endosperm and nonendosperm was applied to determine a pure endosperm multivariate identity reflected by the z-axis value for each pixel. The intensity limits from 1 to 0 for endosperm and nonendosperm content correspond to warm and cool colors assigned to the maximum and minimum, respectively, of the scale. Experience is required to subjectively critically examine the data and select the appropriate threshold value below which data are excluded. Whereas care must be taken to establish a subjective maximum purity standard and, in contrast, impurity standard for the bran, standardized data handling makes the subsequent routine calculations objective. It is possible with PLS data treatment to assign a specific endosperm percentage to each pixel and obtain a summation. Once the PLS equations are developed, a custom software interface can be used to rapidly produce endosperm percentage for several raw image files.

Using Chemical Imaging to Optimize Product Purification

An important level of control in a flour mill is the material that passes through the flour (product) sieves. Knowledge of the particle size distribution for each mixture component (endosperm vs. nonendosperm) can assist the miller in maximizing instantaneous flour purity with the intent of increasing the total yield of flour meeting buyer specifications, while providing optimal distribution of the material over the sieve. A balance of these items is important, but it is currently difficult, requiring multiple analytical methods. The present invention provides such a balance by optimizing the aperture size (between 110 and 220 μm) for individual flour sieves.

The data acquisition and data processing element of the present invention can be performed on several different spectroscopic imaging instruments and multiple software platforms. However, a preferred instrument is a Malvern Sapphire NIR imaging spectrometer (Malvern Instruments Ltd., Worcestershire, UK). Malvern SapphireGo software is used to acquire spectral imaging data and Malvern ISys software is used to process the data for quantitation and particle size statistics. An alternative instrument used in our research is the Middleton Spectral Vision ViaSpec (Middleton, WI).

With quantitative chemical imaging, it is possible to reveal and measure the small chemical differences between the wheat parts in intermediate materials in the process as well as in flour extracted under each individual sieve. A chemical molecular structural difference distinguishes the desired product, such as endosperm, from extraneous organic material including pericarp that has a different chemical signature and resultant infrared spectrum. Testing in various milling systems of flour extracted from individual sieves show that it is possible to determine the size and presence of any non-endosperm particles among the product streams. This approach allows determination of the optimal aperture for individual flour sieves in a sifter section to enhance separation. Where measured, it also allows determination of the quantity and size of bran and endosperm particles in other intermediate materials resulting from the milling process.

Potential applications of this invention include the commissioning of new processing plants, optimization of key unit processes at early stages in the processing flow, or customization of sieve openings to selectively separate the analyte from other material in the mixture. The current primary application is intended to achieve optimization of each individual flour sieve in a milling process with the ultimate goal of increasing the overall yield of flour that meets purity specifications. The secondary purpose is to preferentially produce flour in the earliest unit processes that contain purified endosperm. Therefore, the necessity for further processing steps is reduced.

The vibrational spectroscopic method described herein provides the enhanced sensitivity and chemical composition selectivity required to optimize the performance of particle size-based separation steps in a commercial scale milling process. It is believed that this process could add as much as 2-3% more flour resulting in additional revenues ranging from $1.7-2.5 M annually for a single mill. The quantitative chemical imaging used herein addresses both the sensitivity and chemical selectivity required to assess efficiency for wheat milling.

This quantitative spectroscopic imaging method can be used for any intermediate stream or product streams of the wheat milling process. The present invention has the potential to assist millers in optimizing the separation of endosperm from nonendosperm. This chemical imaging process could serve central laboratories for the milling industry, but there is also a further expectation to analyze samples at line in a timely manner for the purpose of making necessary sieve configuration corrections while the mill is being maintained.

The spectral range utilized in this invention is widely applicable and selective for organic compounds. The invention could easily be extended to the processing of other grains or materials of a biological origin, such as optimizing mixing for an animal formulation by observing the loss of heterogeneity of the mixture over time.

Figure 7:
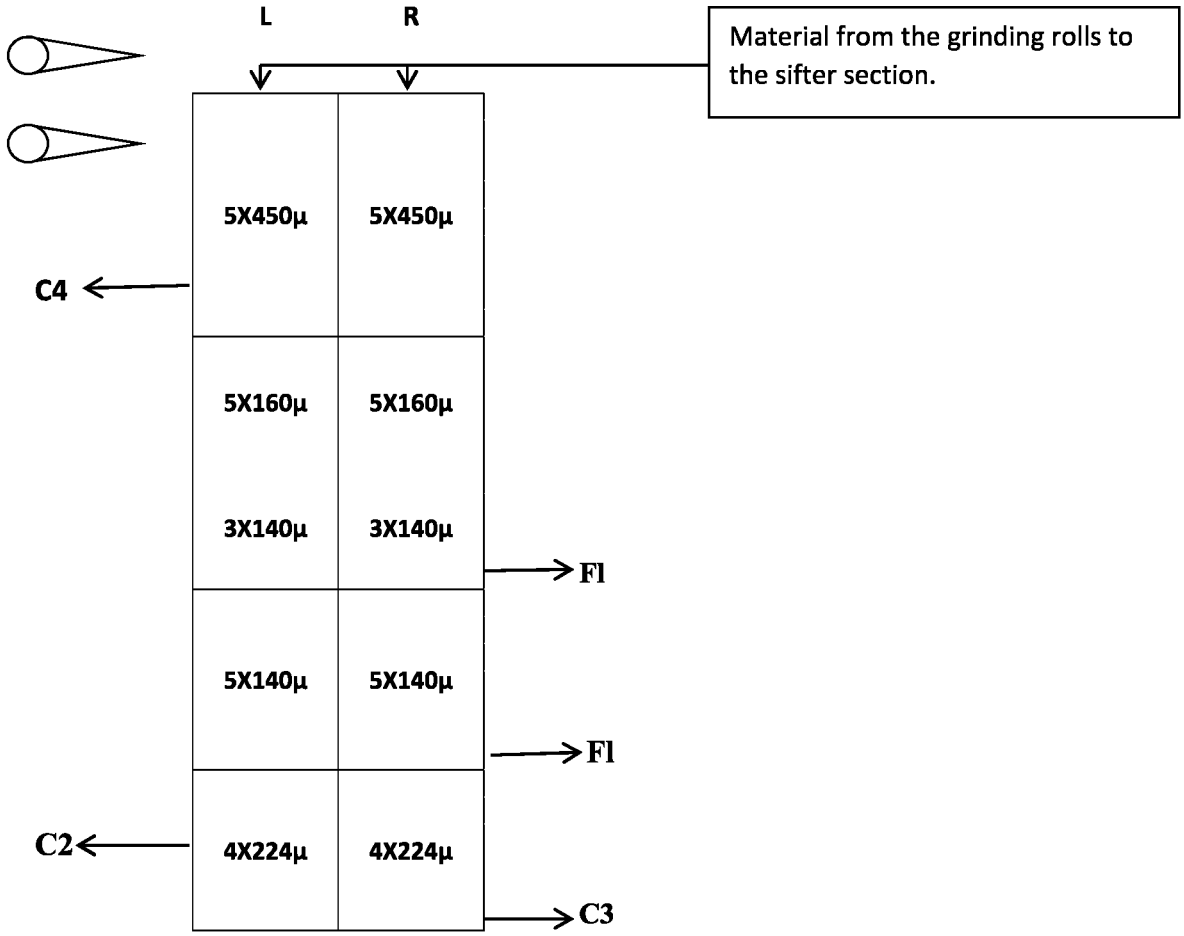
FIG. 7 is a schematic diagram of an original sieve arrangement in a C1a sifter section.

FIG. 7 depicts an exemplary sifting machine that may be employed in a flour mill. In the flour mill there are sifter sections in each of the sieving machines. In a small milling unit of 200 ton/24 hr, there are 24 sections. In a large mill of 650 ton/24 hr, there are at least 40 sections. Routinely, the mill operator checks each sifter section for broken sieves. As can be seen from FIG. 7, there are various sieves with different sized apertures measured in microns. In the material tailing over the flour sieves (to C3 stage in the example shown in FIG. 7), there should not be more than 3-5% flour. The reason for that is to prevent any percentage of fine material passing through the sieves being abraded by the presence of materials such as bran on the sieve surface.

Figure 8:
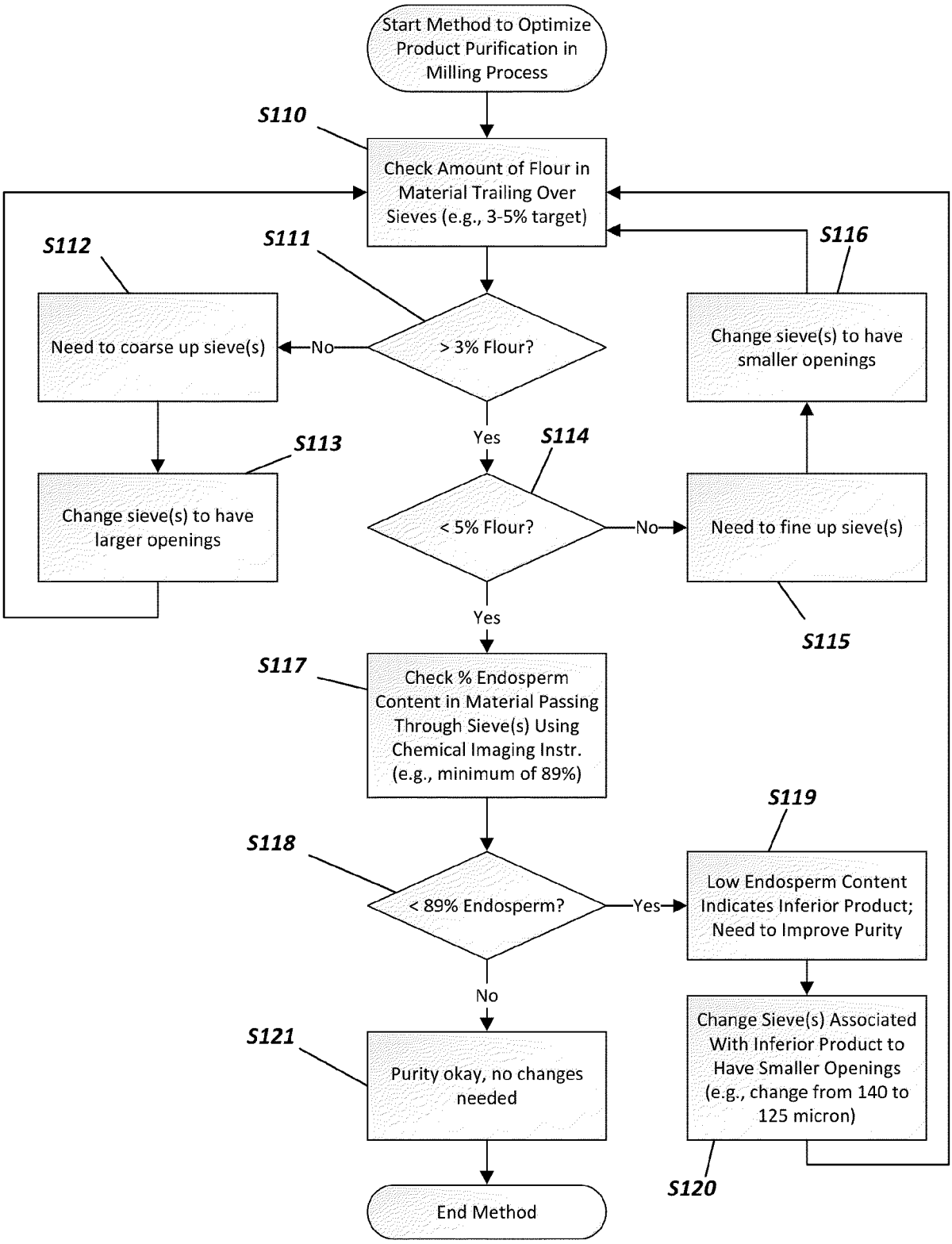
FIG. 8 is a flowchart showing a method of using chemical imaging to optimize product purification in a milling process according to the present invention.

FIG. 8 is a flowchart showing a method of using chemical imaging to optimize product purification in a milling process. In step S110, the amount of flour in the material trailing over the sieves is checked to make sure it is within the desired range (e.g., 3 to 5% by weight). If the amount of flour in the material trailing over the sieves is not greater than 3% (step S111), there is a need to coarse up the sieves (step S112) so the sieves are replaced with sieves having larger openings (step S113). If the amount of flour in the material trailing over the sieves is not less than 5% (step S114), there is a need to fine up the sieves (step S115) so the sieves are replaced with sieves having smaller openings (step S116).

Once the mill stream being examined has 3 to 5% flour content, samples of the mill stream are collected from that sifter and chemically imaged in step S117 using the chemical imaging process described above. The chemical imaging process determines the percentage of endosperm in the sampled mill stream and compares the purity to the target purity (e.g., 89% endosperm) in step S118. If the sample has less than the target purity, there is a need to improve the purity (step S119), so sieves can be changed to have smaller openings (e.g., change from 140 to 125 microns) in step S120. If the sample meets or exceeds the target purity levels, then it is determined that no changes are needed (step S121).

The optimizing process of the present invention will be further described with reference to FIG. 7. The sifting apparatus in FIG. 7 includes 13 flour sieves (i.e., those sieves having openings of 110 to 220 microns). In one embodiment of the present invention, the overs and throughs for each of the 13 flour sieves are analyzed using quantitative chemical imaging to determine whether any of the flour sieves need to be changed or replaced with sieves having smaller or larger screen openings.

The wheat flour milling process is affected by many parameters such as physical characteristics of the grain, moisture, adjustment of grinding machines, and ambient conditions (humidity, temperature, etc.) in the processing space. The decision to take the throughs of the first flour sieves as the optimization target is based on the fact that the top sieve is where the total product mixture starts the sieving process. If the flour from the top sieve shows drastic minimal endosperm content, the reason could be dependent on other process adjustments. The mill operator should be able to identify them with adequate experience and knowledge.

The data generated in the commercial mill for the performance of sieves for the different types of grain processed could be used in the future as a cornerstone for applying artificial intelligence to the flour milling process.

As explained above, applying the present invention to determine and optimize the percentage endosperm and the particle size distribution for material over and through individual product (flour) sieves for a commercial scale milling operation provides potential for economic gain.

Additional Working Examples

1. Wheat Milling Sieving Operations

The present invention has been applied to an atypical soft wheat milling operation using milling experiments for individual flour sieves. Full access to sifter sections during the middle of routine operation was provided intermittently, unlike most commercial operations where profits would be affected. The study of soft wheat milling highlights the utilization of the near infrared chemical imaging technique for a non-traditional milling operation. The unique chemistry of soft wheat varieties also accounted for some differences in processing.

The goal of the majority of milling processing steps is to maximize the value of flour product. The high volume, low margin nature of the flour milling industry makes it essential to optimize each individual operation and process setting. Several chemical imaging experiments were performed to quantify potential dysfunctional operation of key unit processes for the mill. Each milling process has several outgoing streams that are controlled by the action of sieving, and the action on each sieve frame is inherently dissimilar. Because some of the non-endosperm and endosperm particles are in a mixture of material below 212 microns, sieves with the appropriate micron size are selected to separate as much purer endosperm (flour) from the mixture. However, the miller typically does not have the opportunity to examine the effect of each successive frame. With chemical analysis of the material passing over and through individual sieves, the miller can directly control or monitor the flour being produced at a finer level of control.

Two commercial near infrared imaging instruments were used in this study to acquire data. The Malvern Sapphire® near infrared quantitative imager (Malvern Instruments Ltd., Westborough, MA) used for the complementary studies was the basis of the development of the spectroscopic imaging technique for wheat milling streams. The second instrument was a Middleton Spectral Vision ViaSpec DAQ Short Wave Infrared model no. MRC-303005-1 push broom array imaging spectrometer (Middleton, WI). Each sample image is treated by a unique chemical classification procedure based upon endosperm and non-endosperm sample data in excess of 200,000 pixels. The mean value for all of the pixels yields the quantitative result.

The mill studied was not fully optimized even though it had been commissioned for regular milling. This was because the buyer and miller were owned by the same company and any temporary inconsistency was authorized. Also, several equipment choices hampered the production of a sufficient quantity of pure flour. Each sifter frame contains sieve cleaners that perturb the sieve surface; however, they were not fully functional for many of the flour sieves and had to be replaced. This had caused the sifting space to be inefficient in the separation of fine endosperm. Also, the sieve stockings that connect the sifter to the spouting were not optimized and caused blockages in the sifters from the bottom up and complete mill shutdown. The material being sent to the purifiers was not optimized for the current break release settings; the amount of material released from the break system to other stages of the mill. Likewise, the sieve configuration on the purifier was not allowing proper segregation of products to the reduction operations.

Sieving Experiments

The novel portion of our experimentation is the heretofore unrealized optimization of the individual repeating sieves within a sifter section. The primary goal is to maximize endosperm purity and yield for the material passing through each individual flour sieve and optimizing within the 110-220 μm apertures typically used for flour sieves. The sampling procedure for individual streams required the milling operation to be stopped. The sifter boxes were opened for regular maintenance such as checking for sieve blockages and holes. Then, samples could be collected from the material on top of and below each sieve. This allows the miller to see the effective separation for each sieve and compare the effect of subsequent sieves.

Figure 9:
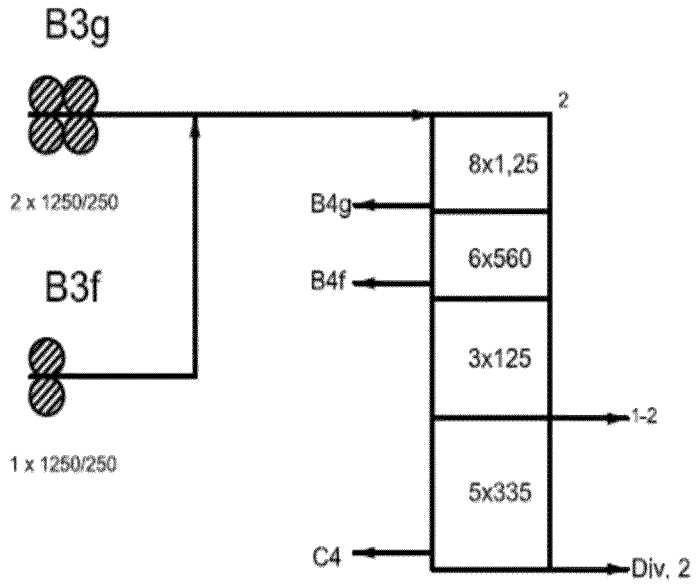
FIG. 9 is a diagram of a sieving operation used in a wheat milling sieving process.

Eight sieving operations were studied with the technical nomenclature of B3, C1b, C2, C4, C5, C10, C12, and Div 3. The B3 sifter stack was studied as a matter of convenience, given that there were problems with several sieves in the stack. Our results showed that the B3 sifting operation, as shown in FIG. 9, had an approximately 34% enrichment in endosperm purity for flour streams, however, the flour was of negligible quality (approximately 75% endosperm).

Figure 10:
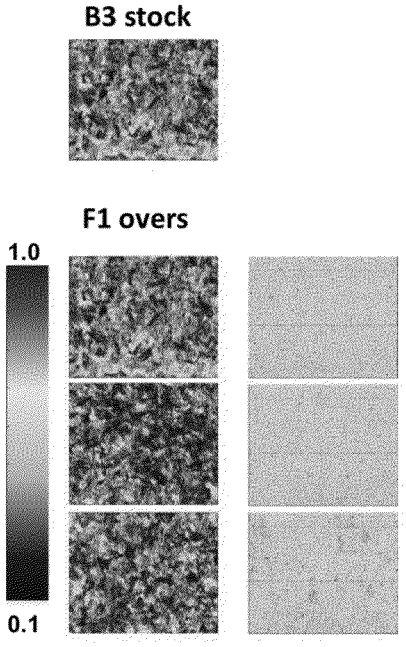
FIG. 10 are chemical images of samples taken from the stock, overs and thrus of the sieving operation shown in FIG. 9.

FIG. 10 shows the chemical images for the overs and thrus for the B3 sifting operation. As can be seen in FIG. 10, the expanded color scale indicates endosperm purity with warm false colors.

TABLE 1

| B3 Flour Sieve Endosperm Values | | | | |
|---|---|---|---|---|
| B3 flour sieves | | | | |
| % Endo | | Sieve size (microns) | Sieve # | Sample # |
| 47.07% | + | 140 | 1 | D1 |
| 76.47% | - | | 1 | D2 |
| 41.23% | + | | 2 | D3 |
| 75.43% | - | | 2 | D4 |
| 39.84% | + | | 3 | D5 |
| 77.58% | - | | 3 | D6 |

The initial stock to the B3 flour sieves was approximately 47% endosperm (Table 1). The lower purity stock of the overs (39.8%) would typically be sent to flour production steps, however, given the purity of this fraction, it is highly likely that this material should head to a reclamation step instead. The results also indicated that significant optimization of the first three break operations was necessary to reorganize the granulation. The B3 sieving operation was later adjusted and grab sampling of the flour indicated a significant increase in purity to approximately 83% endosperm for a moderate yield of flour.

The C1b sifter stack is illustrated in FIG. 11. The origin of C1b stock is the coarser, dense purified endosperm. There were six sieves in the C1b sifter stack that produced a fine flour (140 μm) and four sieves below for a coarse flour (160 μm).

Each C1b overs stock (fine and coarse) had similar endosperm values; however, we observed additional fines in the flour 1 (F1) overs.

Chemical images of the C1b flour sieve overs and thrus are shown in FIG. 12. Note the enriched flour product and similar intensity of F1 and F2 flour images. Note the expanded color scale that indicates endosperm purity with warm false colors. From the imaging shown in FIG. 12, we also noted a large amount of bran contamination in the fourth sieve flour of F1 where the overs had a higher purity than the thrus. This indicted a faulty sieve. Also, for the flour 2 (F2) sieves, the product clearly drops off for the last two sieves. This indicates that decreasing the sieve aperture should remove some additional non-endosperm particles from the flour.

The ash and endosperm values were contradictory for the sifting experiment indicating that additional aleurone or outer endosperm is present in the flour for this operation (Table 2). This indicates the deficiency of the ash determination. This material would have functional ability for baking etc., but would not meet ash standards. Optimization of the stock sent to the C1b process is the ideal method to increase the purity of the flour.

TABLE 2

| C1b flour sieve data for overs (+) and thrus (-) | | | | | |
|---|---|---|---|---|---|
| C1b flour sieves | | | | | |
| % Ash | % Endo | | Sieve size (microns) | Sieve # | Sample # |
| 0.905% | 85.22% | + | 140 | 10 | A1 |
| 0.669% | 88.47% | - | | 10 | A2 |
| 0.960% | 85.57% | + | | 11 | A3 |
| 0.629% | 88.82% | - | | 11 | A4 |
| 0.928% | 85.93% | + | | 12 | A5 |
| 0.630% | 88.84% | - | | 12 | A6 |
| 0.945% | 88.49% | + | | 13 | A7 |
| 0.642% | 87.75% | - | | 13 | A8 |
| 0.927% | 86.28% | + | | 14 | A9 |
| 0.643% | 89.45% | - | | 14 | A10 |
| 0.966% | 87.56% | + | | 15 | A11 |
| 0.642% | 88.86% | - | | 15 | A12 |
| 0.934% | - | + | 160 | 16 | A13 |
| 0.593% | 90.20% | - | | 16 | A14 |
| 0.950% | 86.97% | + | | 17 | A15 |
| 0.599% | 90.70% | - | | 17 | A16 |
| 1.120% | 83.37% | + | | 18 | A17 |
| 0.593% | 86.02% | - | | 18 | A18 |
| 0.993% | 82.45% | + | | 19 | A19 |
| 0.582% | 87.33% | - | | 19 | A20 |

A flow sheet diagram for the C2 sifter stack is illustrated in FIG. 13. The origin of the incoming stock was fairly coarse. There were two flour streams produced on thirteen 140 μm and five 160 μm sieves, respectively. The C2 enrichment for flour purity was approximately 35%.

FIG. 14 shows chemical images resulting from the C2 sieving analysis. Note the expanded color scale that indicates endosperm purity with warm false colors.

TABLE 3

| C2 flour sieve data for overs (+) and thrus (-) | | | | | |
|---|---|---|---|---|---|
| C2 flour sieves | | | | | |
| % Ash | % Endo | | Sieve size (microns) | Sieve # | Sample # |
| 1.797% | 71.47% | + | 140 | 6 | B1 |
| 0.627% | 83.92% | - | | 6 | B2 |
| N/A | N/A | + | | 7 | B3 |
| 0.571% | 85.65% | - | | 7 | B4 |
| 3.483% | 41.48% | + | | 8 | B5 |
| 0.654% | 84.98% | - | | 8 | B6 |
| 3.790% | 44.97% | + | | 9 | B7 |
| 0.616% | 86.97% | - | | 9 | B8 |
| 3.268% | 52.50% | + | | 10 | B9 |
| 0.561% | 88.64% | - | | 10 | B10 |
| 3.019% | 47.77% | + | | 11 | B11 |
| 0.603% | - | - | | 11 | B12 |
| 2.850% | 55.86% | + | | 12 | B13 |
| 0.587% | 86.95% | - | | 12 | B14 |
| 2.790% | 46.02% | + | | 13 | B15 |
| 0.719% | 87.07% | - | | 13 | B16 |
| 2.905% | 48.84% | + | 160 | 14 | B17 |
| 0.653% | 86.88% | - | | 14 | B18 |
| 3.034% | 55.56% | + | | 15 | B19 |
| 0.636% | 88.39% | - | | 15 | B20 |
| 2.571% | 51.58% | + | | 15 | B21 |
| 0.647% | 88.06% | - | | 16 | B22 |
| 2.775% | 56.16% | + | | 17 | B23 |
| 1.508% | 86.32% | - | | 17 | B24 |
| 2.624% | 52.43% | + | | 18 | B25 |
| 0.658% | 87.78% | - | | 18 | B26 |

From the initial C2 stock it was noted that there was still a fair amount of product available (FIG. 14). Likewise, the first initial sieving process removed a lot of flour product.

The purity values for the C2 sieve increase going farther down the stack of 140 μm sieves, indicating that there may be a lot of initial fine bran contamination in the stream (Table 3). However, the purity increases for later streams and the coarse flour fraction contains a lot of endosperm in comparison to the fine flour (87.5% vs. 86.3%).

Visual analysis of the sieve fractions shows that Sieve #7 contains a lot of extra non-endosperm material in the flour stream. Also, visual inspection of the second group of flour sieves shows slightly smaller particles of non-endosperm being introduced. Sieve #4 shows the most amount of bran contamination. In comparison to the C1b stock, we note that the C2 operation produces a similar quality flour with an initial stock that is 14% lower in endosperm content. Adjustment of the milling procedures provided a similar amount of flour yield, resulting in flour purity increases to 89.6% and 89.8% endosperm, respectively.

Figure 15:
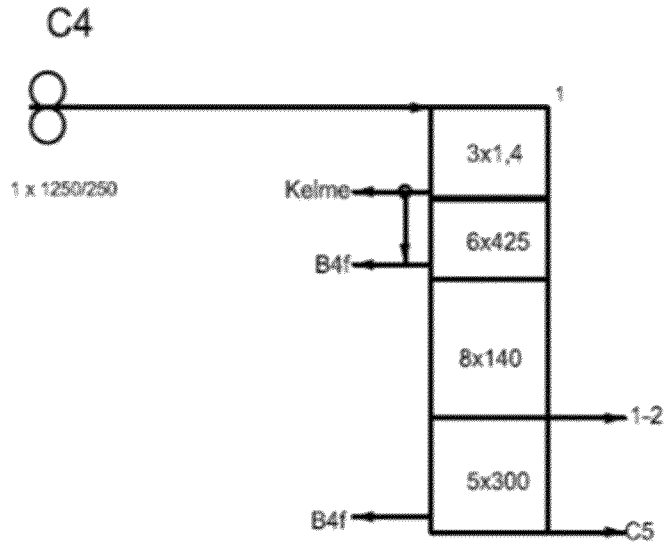
FIG. 15 is a diagram of another sieving operation used in a wheat milling sieving process.

The C4 sifter experiment had 8 sieves (140 μm) that produced one flour (FIG. 15). The C4 operation was hard to control because several moderately coarse streams are combined for the incoming stock. The C4 sieving experiment showed an average 31% enrichment of endosperm purity from the raw material to flour.

Figure 16:
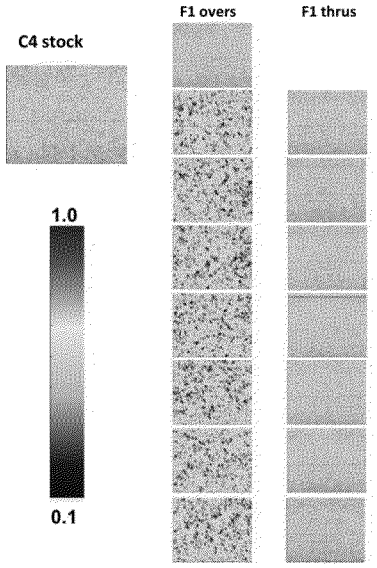
FIG. 16 are chemical images of samples taken from the stock, overs and thrus of the sieving operation shown in FIG. 15.

FIG. 15 is a flow sheet diagram of the C4 sifting process. Note the flour stream from 8-140 μm sieves. Corresponding chemical images of the overs and thrus are shown in FIG. 16. Note the expanded color scale that indicates endosperm purity with warm false colors.

Figure 17:
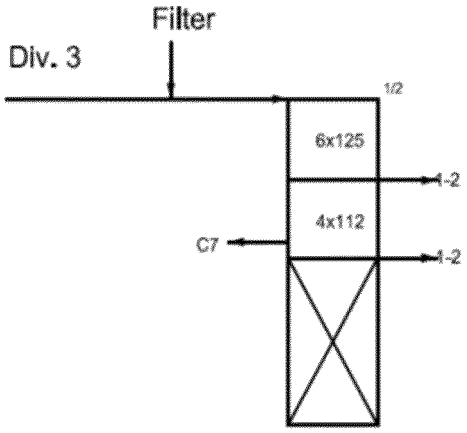
FIG. 17 is a diagram of another sieving operation used in a wheat milling sieving process.

The Div 3 sifter stack had 10 sieves (6-125 μm and 4-112 μm) devoted to the production of two flour streams (FIG. 17). The remaining material was sent to C7, the beginning of the secondary reduction system. The Div 3 operation handled extra fines of the milling systems. One sample was excluded from the Div 3 analysis, because there was a hole in the second sieve. The incoming material for the process had an endosperm content of approximately 57.5% (Table 4). Endosperm was readily removed down the sifter for an average enrichment of 12%; however, the flour had minimal value at approximately 69% endosperm throughout the sifter. Approximately 4% of the mill flour was attributed to Div 3, but much of this material is best suited for the secondary reduction system. Minor adjustments alone resulted in an increase in the purity of Div 3 flour to approximately 73.5%. However, the image analysis indicated there is additional mill optimization needed. The cost effective alternative would be to increase the sifter apertures for the flour sieves.

Figure 18:
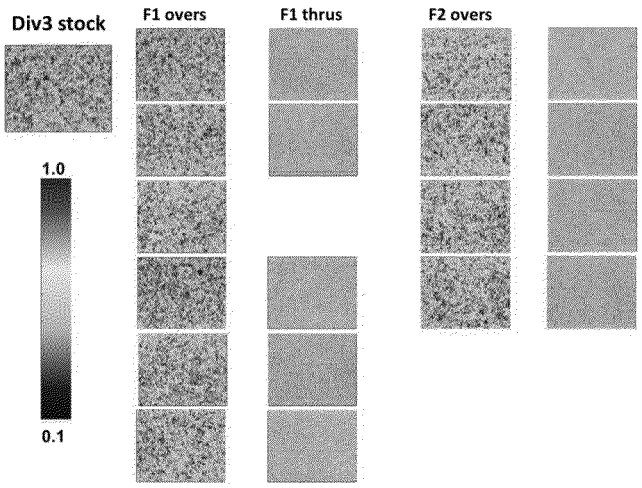
FIG. 18 are chemical images of samples taken from the stock, overs and thrus of the sieving operation shown in FIG. 17.

FIG. 17 is a flow sheet diagram of the Div 3 sifting process. Note that two flour streams are produced from 6-125 μm (coarse) and 4-112 μm (fine) sieves. Corresponding chemical images of the overs and thrus are shown in FIG. 18. Note the expanded color scale that indicates endosperm purity with warm false colors.

TABLE 4

| Div 3 flour sieve data for overs (+) and thrus (-) | | | | |
|---|---|---|---|---|
| Div 3 flour sieves | | | | |
| % Endo | | Sieve size (microns) | Sieve # | Sample # |
| 57.52% | + | 125 | 1 | C1 |
| 68.25% | - | | 1 | C2 |
| 58.22% | + | | 2 | C3 |
| - | - | | 2 | C4 |
| 59.01% | + | | 3 | C5 |
| 68.57% | - | | 3 | C6 |
| 54.52% | + | | 4 | C7 |
| 70.94% | - | | 4 | C8 |

TABLE 4-continued

| Div 3 flour sieve data for overs (+) and thrus (-) | | | | |
|---|---|---|---|---|
| Div 3 flour sieves | | | | |
| % Endo | | Sieve size (microns) | Sieve # | Sample # |
| 58.54% | + | | 5 | C9 |
| 69.00% | - | | 5 | C10 |
| 60.24% | + | | 6 | C11 |
| 73.22% | - | | 6 | C12 |
| 58.31% | + | 112 | 7 | C13 |
| 72.10% | - | | 7 | C14 |
| 59.02% | + | | 8 | C15 |
| 70.05% | - | | 8 | C16 |
| 60.17% | + | | 9 | C17 |
| 70.42% | - | | 9 | C18 |
| 57.82% | + | | 10 | C19 |
| 68.91% | - | | 10 | C20 |

2. Corn Processing

The primary goal of the corn processing industry is to isolate the soft, starchy endosperm from the other botanical components of the kernel. The chemical imaging method is applicable for the purpose of determining either the purity of intermediate streams for the dry milling process or the residual starch remaining on byproducts of the wet milling procedure. The purpose of analyzing the dry milling procedures is to optimize the sifting apparatus for the production of pure byproducts and starch.

The wet milling procedure byproducts are germ, bran, fiber, gluten, and distillers grains. The starch content of these byproduct streams is easily determined by application of the chemical imaging method with a library composed of purified byproduct and corn starch spectra. The amount of starch remaining on the byproducts of the wet milling process can be determined by performing the chemical imaging process described herein on samples collected from the byproduct streams. The miller can use the quantitative results of the chemical imaging to adjust operational parameters of the wet milling process, such as steeping, grinding, and screening to change the starch content of the byproduct stream.

The corn milling industry also has potential for the determination of anthocyanin enriched corn for the health market. These products are easily discernible by their reduced starch availability and increased fiber, protein, and oil.

3. Wet Milling of Other Grains

The benefit of the chemical imaging method is applicable to the several wet milling markets for the production of ethanol from grain (buckwheat, sorghum, etc.). This procedure would mimic that of the corn wet milling industry and determine the starch remaining on the byproducts.

4. Dry Milling of Other Grains

Typically, the dry milling of most grains involves the production of whole grain flour with a smaller market share. However, for a few such as rice and sorghum, the optimization of sieves follows the same theory as that for wheat milling. Rice in particular, is used as an alternative source of flour for those with gluten intolerance.

While the invention has been described in connection with specific embodiments thereof, it is to be understood that this is by way of illustration and not of limitation, and the scope of the appended claims should be construed as broadly as the prior art will permit.

The invention claimed is:

1. A method of improving the separation of endosperm and nonendosperm material from a ground product within a sifting apparatus of a commercial milling system after a grinding process has taken place, the sifting apparatus comprising a plurality of stacked sieves, each of the sieves comprising a screen having openings that permit particles of a predetermined size to pass therethrough during operation of the sifting apparatus, the method comprising:

performing chemical imaging on at least one sample of the ground product taken from material flowing over or passing through one or more of said sieves to determine amounts of endosperm and nonendosperm material present in the ground product, said chemical imaging comprising acquiring spatially resolved spectroscopic imaging data for said at least one sample of the ground product and comparing pixels of the acquired imaging data with reference libraries of spectra developed from analytical standards for pure endosperm to determine a quantitative amount of endosperm present in the ground product; and changing at least one of the sieves within the sifting apparatus based on said chemical imaging to provide smaller or larger screen openings to improve separation of endosperm and nonendosperm material from the ground product by the sifting apparatus.

2. The method of claim 1, wherein changing at least one of the sieves comprises replacing at least one of the sieves with a replacement sieve comprising smaller or larger screen openings.

3. The method of claim 2, wherein the replacement sieve comprises screen openings of from about 110 to about 220 microns.

4. The method of claim 1, further comprising analyzing results from said chemical imaging to determine particle sizes of endosperm and nonendosperm material in the ground product.

5. The method of claim 4, wherein determining particle sizes of the endosperm and nonendosperm material is performed via false color contrast.

6. The method of claim 1, further comprising using said chemical imaging to determine an optimal opening size for at least one of said sieves to achieve purity and maximize yield for a mill stream within the milling system.

7. The method of claim 1, wherein changing at least one of the sieves within the sifting apparatus results in recovery of at least 1% by weight of additional pure endosperm material from said sifting apparatus.

8. The method of claim 1, wherein said chemical imaging is performed with an imaging spectrometer.

9. The method of claim 1, wherein the chemical imaging comprises near infrared chemical imaging.

10. The method of claim 1, wherein said ground product is grain comprising seeds of an angiospermic plant.

11. The method of claim 1, wherein said ground product is a grain selected from the group consisting of: wheat, rice, sorghum, oats, rye, corn and quinoa.

12. The method of claim 1, wherein said ground product is a commercial cereal grain.

13. The method of claim 1,wherein chemical imaging software is used to provide selective analysis of complex biological mixtures for endosperm to produce a mathematical result concurrently with image acquisition.

14. A method of improving the separation of endosperm and nonendosperm material from a ground product within a sifting apparatus of a milling system, the sifting apparatus comprising a plurality of stacked sieves, each of the sieves comprising a screen having openings that permit particles of a predetermined size to pass therethrough during operation of the sifting apparatus, the method comprising:

performing chemical imaging on at least one sample of the ground product taken from material flowing over or passing through one or more of said sieves to determine amounts of endosperm and nonendosperm material present in the ground product, said chemical imaging comprising acquiring spatially resolved spectroscopic imaging data for said at least one sample of the ground product and comparing pixels of the acquired imaging data with reference libraries of spectra developed from analytical standards for pure endosperm to determine a quantitative amount of endosperm present in the ground product; and changing at least one of the sieves within the sifting apparatus based on said chemical imaging to provide smaller or larger screen openings to improve separation of endosperm and nonendosperm material from the ground product by the sifting apparatus;

wherein a plurality of samples are taken while the sifting apparatus is off-line, and said chemical imaging is performed on said plurality of samples.

15. The method of claim 14, wherein said samples are collected from material on top of and below a plurality of sieves in said sifting apparatus.

16. The method of claim 14, wherein said samples on which the chemical imaging is performed are collected from over and under a plurality of sieves in said sifting apparatus while the milling system is shut down with the sieves fully loaded with ground product.

* * * * *